US006968870B1

(12) United States Patent
Tsay

(10) Patent No.: US 6,968,870 B1
(45) Date of Patent: Nov. 29, 2005

(54) AUTOMATIC SUCTION STRUCTURE OF A VACUUM CONTAINER

(76) Inventor: Shiu-Chu Tsay, No.5, Alley 19, Lane 248, Fuyi Rd., Taiping City, Taichung County (TW)

( * ) Notice: Subject to any disclaimer, the term of this patent is extended or adjusted under 35 U.S.C. 154(b) by 127 days.

(21) Appl. No.: 10/651,069

(22) Filed: Aug. 29, 2003

(51) Int. Cl.[7] ..... B65B 31/04
(52) U.S. Cl. ..... 141/65; 141/95; 220/203.19
(58) Field of Search ..... 141/65, 67, 95, 141/94, 192, 198; 220/203.01, 203, 212; 215/228, 311; 417/437; 99/472

(56) References Cited

U.S. PATENT DOCUMENTS 6,662,831 B2 * 12/2003 Chen ..... 141/65
6,830,081 B1 * 12/2004 Chen ..... 141/65

* cited by examiner

*Primary Examiner*—Timothy L. Maust
(74) *Attorney, Agent, or Firm*—Egbert Law Offices

(57) ABSTRACT

A vacuum container includes an automatic suction structure mounted in a cap of the vacuum container for drawing air out of the hollow interior of a container body. The suction structure includes an electric suction device, a detecting device, a monitoring device, and a releasing device. The suction device is used to create a vacuum in the hollow interior of the container body. The detecting device is used to detect the leak between the cap and the container body. The monitoring device is intended to monitor the vacuum state in the hollow interior of the container body. The releasing device is used to enable the cap and the container body to be separated from each other.

5 Claims, 7 Drawing Sheets

AUTOMATIC SUCTION STRUCTURE OF A VACUUM CONTAINER

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to the suction structure of a vacuum container, and more particularly to an automatic suction structure capable of monitoring and maintaining constantly the vacuum state of a vacuum container.

BACKGROUND OF THE INVENTION

The conventional suction structure of a vacuum container is generally primitive in design in that it comprises a suction pump and a one-way valve, which are fastened with a cap of the vacuum container. The suction pump is used to draw air out of the hollow interior of the container in conjunction with the one-way valve. The conventional suction structure does not work effectively to bring about a vacuum state of the container. In addition, the conventional suction structure is not reliable at best in view of the fact that it is not provided with means to monitor and maintain the vacuum state of the vacuum container.

BRIEF SUMMARY OF THE INVENTION

The primary objective of the present invention is to provide a vacuum container with an automatic suction structure comprising an electric suction device, a detecting device, a monitoring device, and a releasing device. The automatic suction structure of the present invention works effectively to keep the vacuum container in an airtight condition for an indefinite period of time.

The features and the advantages of the present invention will be more readily understood upon a thoughtful deliberation of the following detailed description of the present invention with reference to the accompanying drawings.

DETAILED DESCRIPTION OF THE INVENTION

Figure 1:
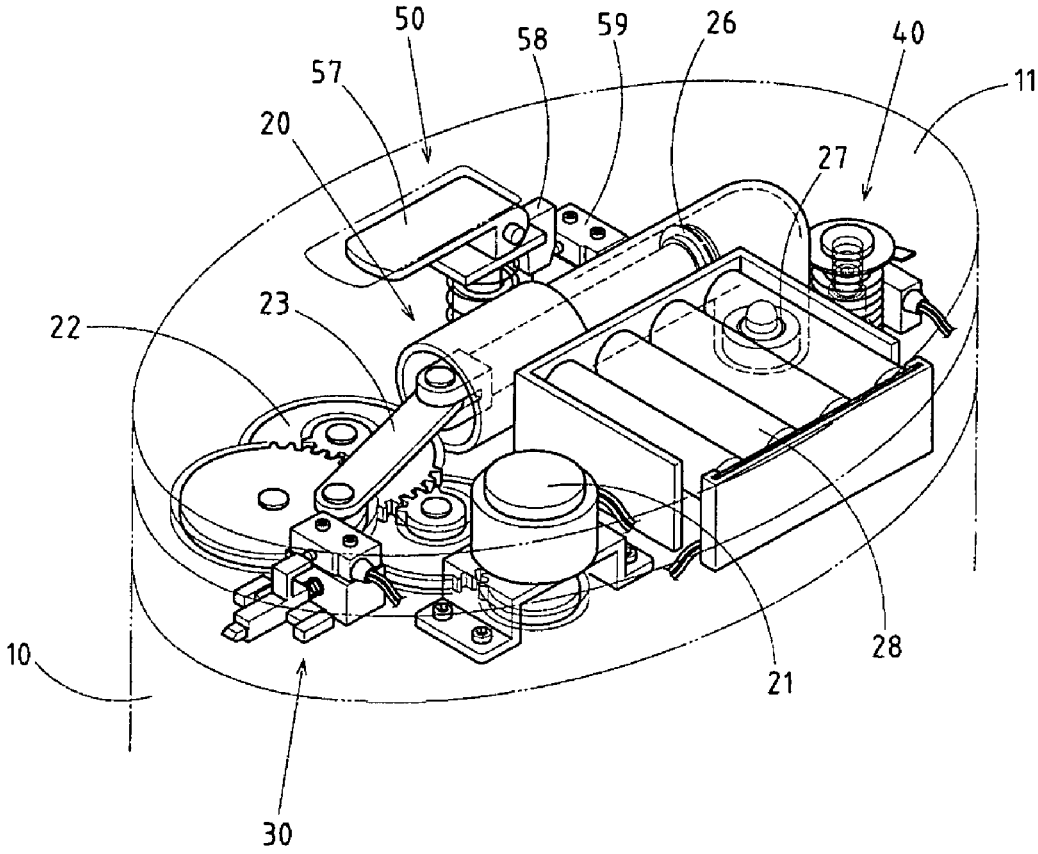
FIG. 1 shows a perspective view of the present invention.
Figure 2:
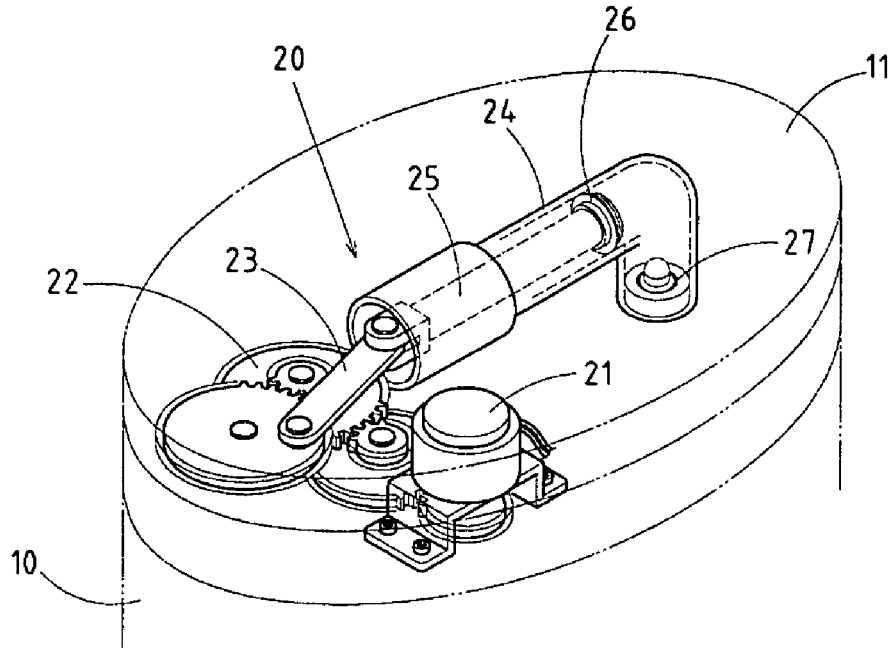
FIG. 2 shows a perspective view of the suction device of the present invention.
Figure 3:
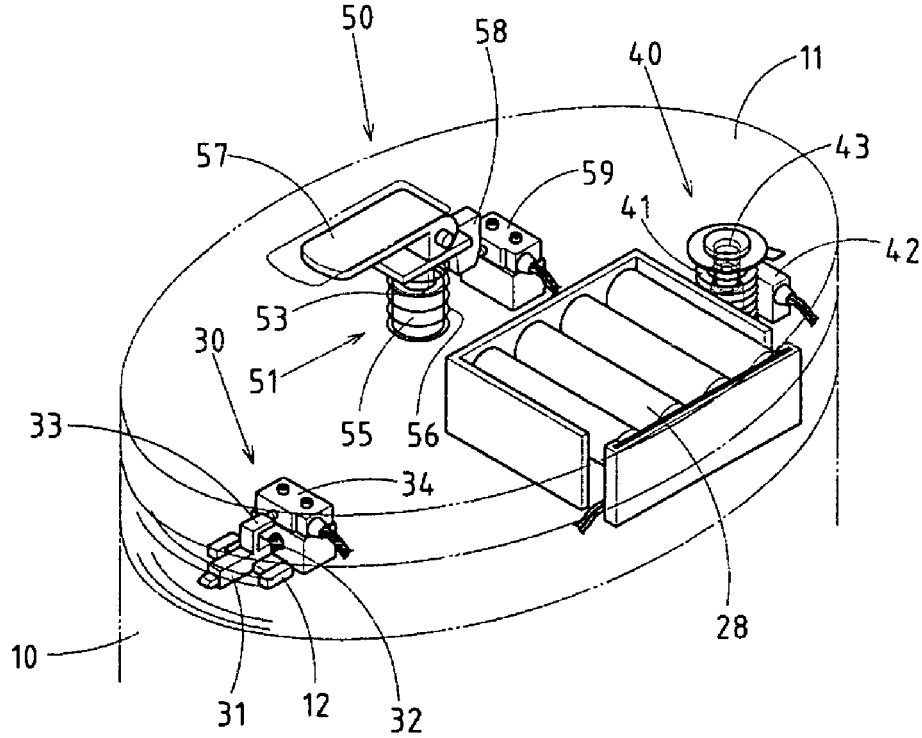
FIG. 3 shows a perspective view of the detecting device, the monitoring device, and the releasing device of the present invention.
Figure 4:
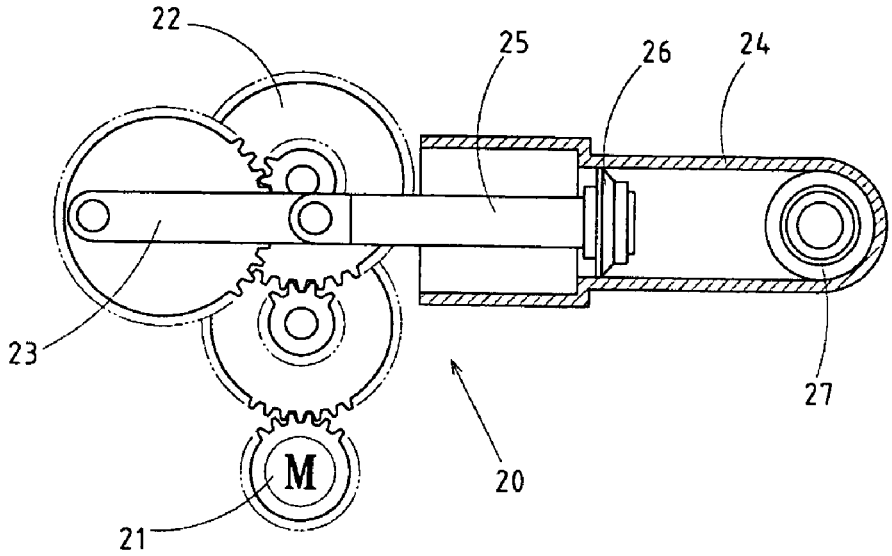
FIG. 4 shows a top plan view of the suction device of the present invention.
Figure 5:
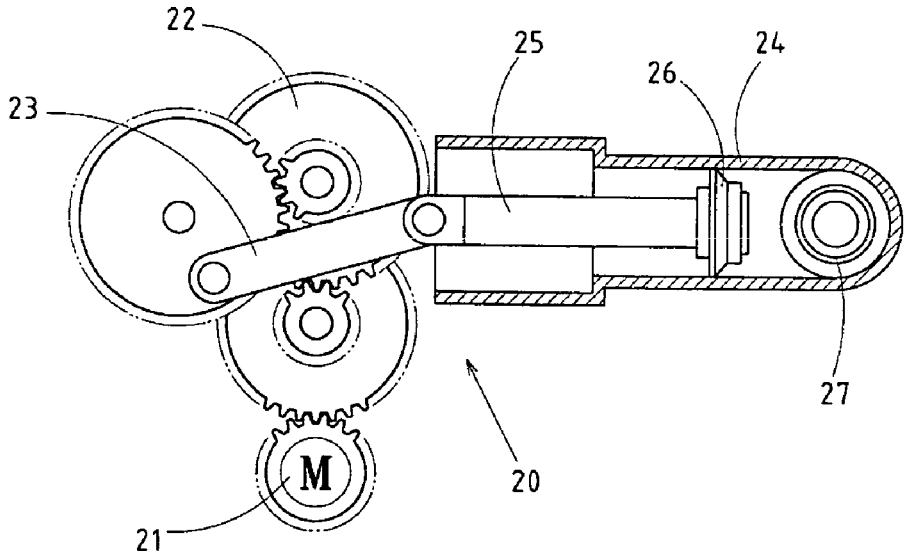
FIG. 5 shows a top plan view of the suction device of the present invention in action.
Figure 6:
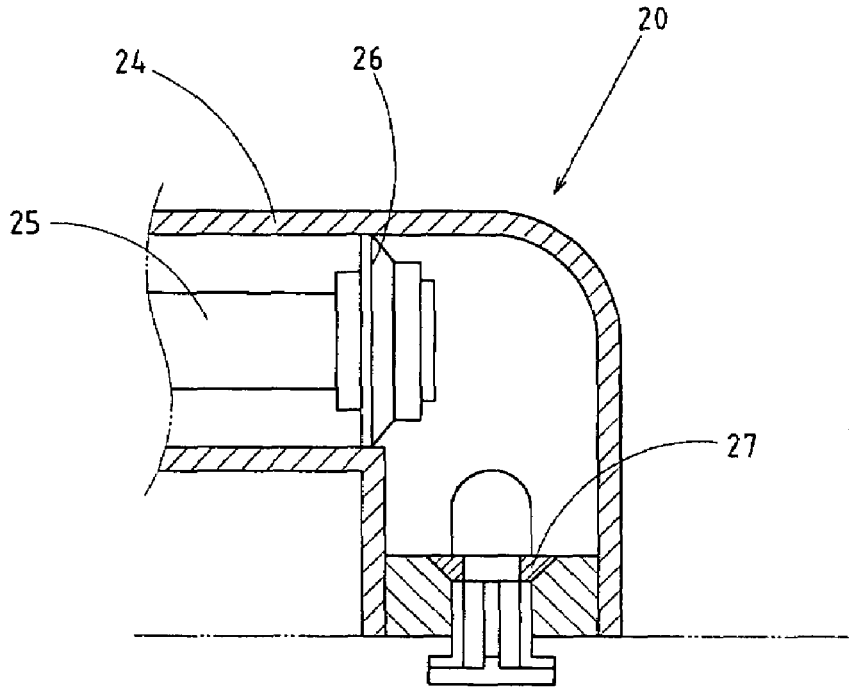
FIG. 6 shows a partial schematic view of the suction device of the present invention.
Figure 7:
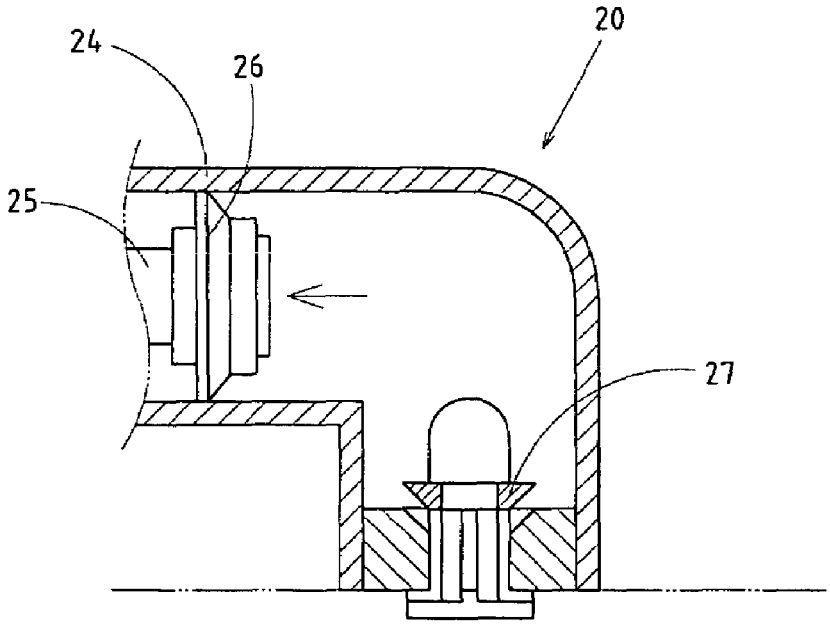
FIG. 7 shows a partial schematic view of the suction device of the present invention in action.
Figure 8:
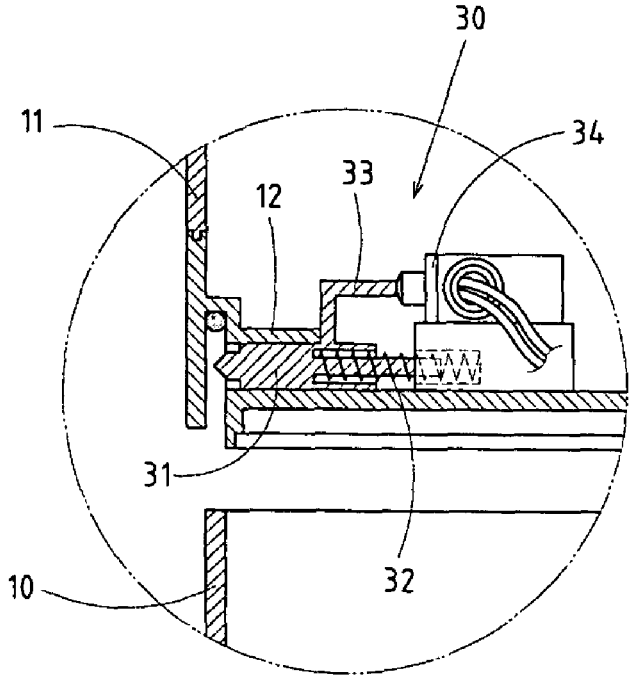
FIG. 8 shows a schematic view of the detecting device of the present invention.
Figure 9:
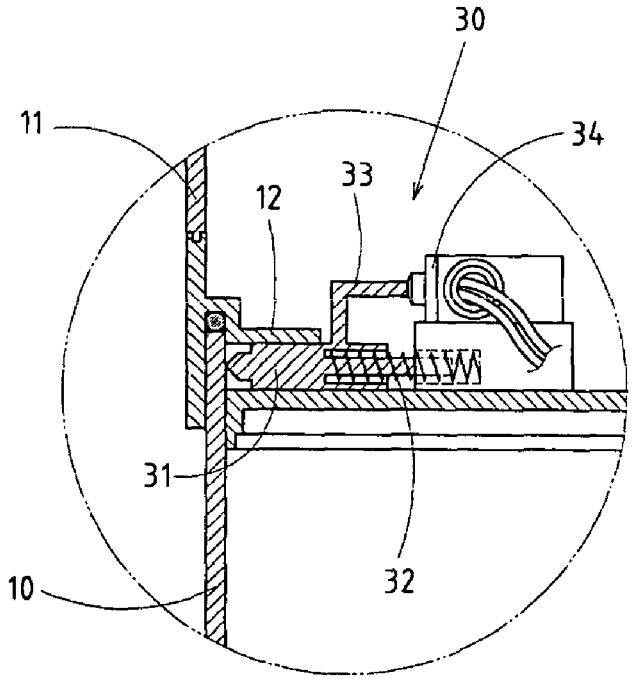
FIG. 9 shows a schematic view of the detecting device of the present invention at work.
Figure 10:
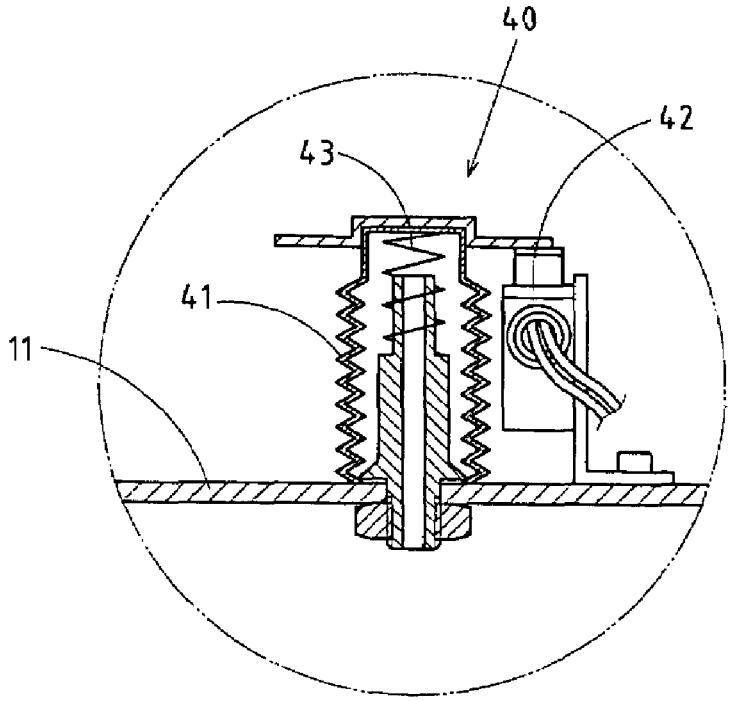
FIG. 10 shows a schematic view of the monitoring device of the present invention.
Figure 11:
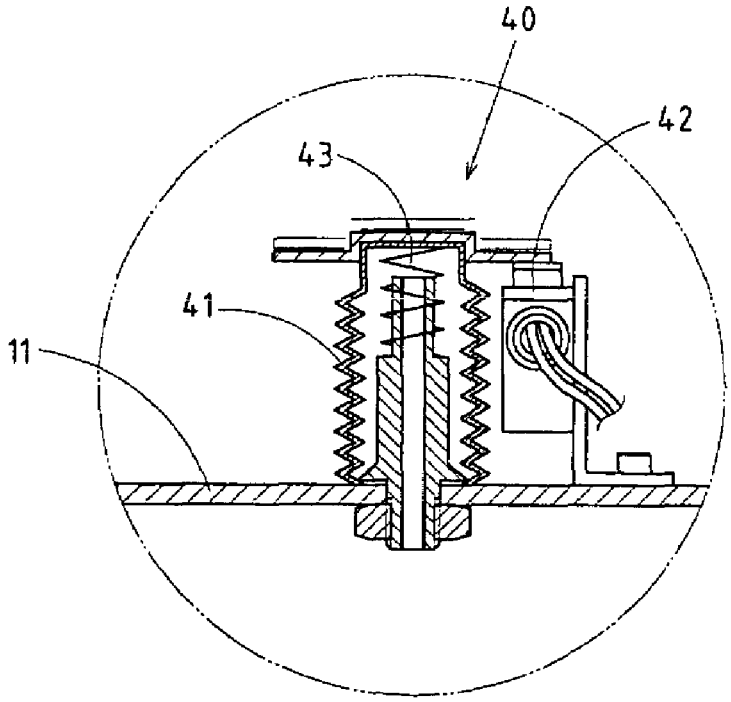
FIG. 11 shows a schematic view of the monitoring device of the present invention at work.
Figure 12:
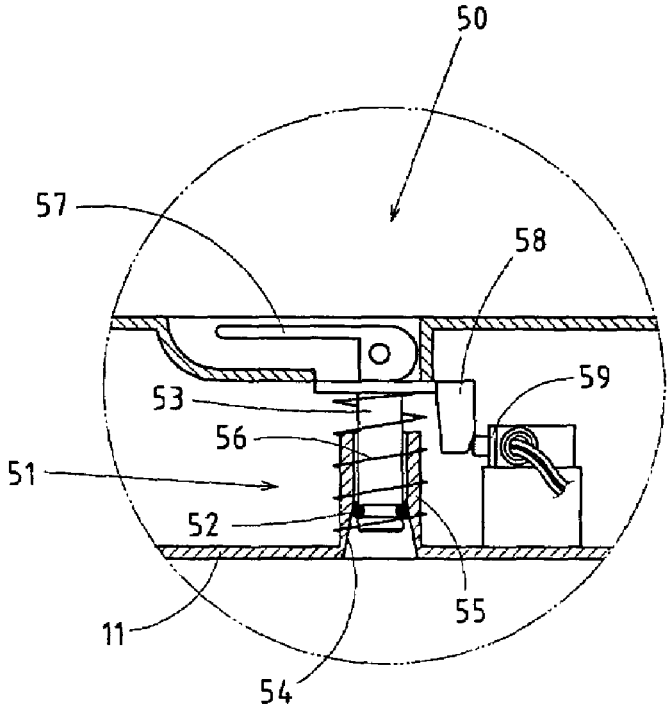
FIG. 12 shows a schematic view of the releasing device of the present invention.

As shown in FIG. 1, a vacuum container embodied in the present invention comprises a hollow body 10, a cap 11, and an automatic suction structure mounted in the cap 11. The automatic suction structure comprises an electric suction device 20, a detecting device 30, a monitoring device 40, and a releasing device 50.

As shown in FIGS. 1, 2, 4, 5, 6, and 7, the suction device 20 comprises a motor 21, a deceleration gear set 22 driven by the motor 21, a connection rod 23 actuated by the deceleration gear set 22, a suction pump 24, a piston rod 25 disposed slidably in the suction pump 24 such that one end of the piston rod 25 is fastened with the connection rod 23, a piston 26 fastened with other end of the piston rod 25, and an air-exhausting valve 27. The suction pump 24 works to draw air out of a hollow interior of the container body 10 in conjunction with the air-exhausting valve 27. The motor 21 is connected to a power source, which is a built-in battery set 28. The motor 21 may be externally connected to a power source.

As shown in FIGS. 1, 3, 8, and 9, the detecting device 30 is mounted in an edge of the cap 11 such that the detecting device 30 is located in a guide portion 12 of the cap 11, and that the detecting device 30 is adjoining to a top rim of the container body 10. The detecting device 30 comprises an action member 31, a recovery element 32, and a contact control element 34. The action member 31 has an action end 33 which is in contact with the contact control element 34 which activates or deactivates a circuit connecting the motor 21 of the suction device 20 and the power source of the motor 21. The detecting device 30 is used to detect the leakage between the cap 11 and the top rim of the container body 10. In another words, the motor 21 of the suction device 20 is prevented from being started by the detecting device 30 in the event that the cap 11 is not properly joined with the top rim of the container body 10.

As shown in FIGS. 1, 3, 10, and 11, the monitoring device 40 comprises an expandable casing 41, a sensor 42, and an auxiliary expandable element 43 disposed in the expandable casing 41. Both the expandable casing 41 and the auxiliary expandable element 43 have one end, which is extended into the hollow interior of the container body 10. The expandable casing 41 and the auxiliary expandable element 43 are capable of responding to a change in air pressure in the hollow interior of the container body 10, thereby triggering the sensor 42 to activated or deactivate the circuit connecting the motor 21 of the suction device 20 and the power source. As a result, a vacuum state of the hollow interior of the container body 10 can be constantly maintained.

Figure 13:
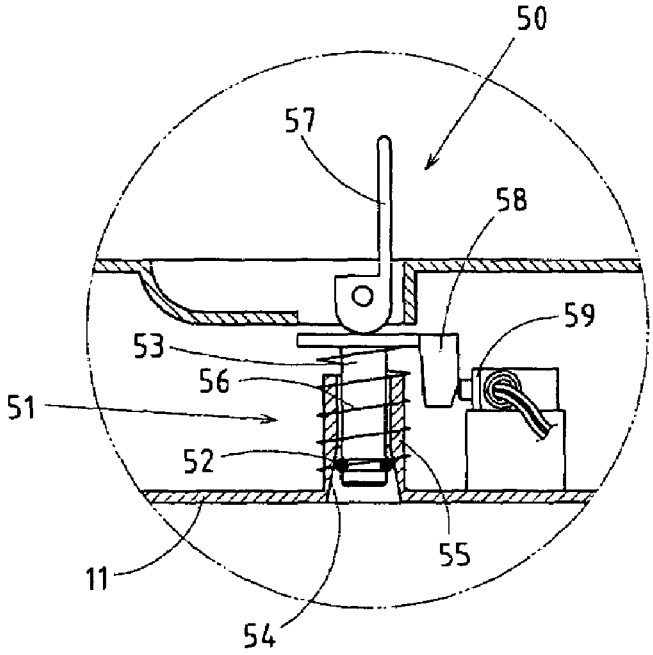
FIG. 13 shows a schematic view of the releasing device of the present invention at work.

As shown in FIGS. 1, 3, 12, and 13, the releasing device 50 comprises a release valve 51 which is formed of a cylindrical body 55 having a release edge 54, a plug 53 having a washer 52, an action rod 57, a contact block 58 linked with the plug 53, and a switching element 59 for interrupting the power supply to the motor 21 of the suction device 20. The plug 53 is slidably disposed in the cylindrical body 55 in conjunction with a spring 56. The action rod 57 is used to activate or deactivate the release valve 51. When the plug 53 is acted on by the action rod 57, the hollow interior of the container body 10 is relieved of a negative pressure. Meanwhile, the contact block 58 triggers the switching element 59 to turn off the power source of the suction device 20, so as to facilitate the separating of the cap 11 from the container body 10. The activation of the releasing device 50 is clearly indicated by the action rod 57, which is jutted out of the cap 11, as shown in FIG. 13.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following claims.

What is claimed is:

1. A vacuum container comprising:

a body having a hollow interior;

a cap having an interior and a shape to fit airtightly with a top rim of said body; and an automatic suction structure disposed in an interior of said cap for drawing air out of the hollow interior of said body;

wherein said automatic suction structure comprises:

a suction device comprised of a motor connected to a power source by a circuit, a deceleration gear set driven by said motor, a suction pump actuated by said deceleration gear set via a connection rod, and an air-exhausting valve in communication with said suction pump;

a detecting device mounted in a guide portion of an edge of said cap and comprised of an action member, a contact control element in contact with one end of said action member, and a recovery element for providing said action member with a recovery force to enable said action member to return to an original position thereof whereby said action member is activated to trigger said contact control element to deactivate the circuit connecting said motor of said suction device with the power source;

a monitoring device comprised of an expandable casing and a sensor whereby said expandable casing is extended at one end into the hollow interior of said body and is capable of changing a size thereof in response to a change in air pressure in the hollow interior of said body, thereby triggering said sensor to activate or deactivate the circuit connecting said motor of said suction device with the power source; and a releasing device comprised of a release valve, a plug slidably disposed in said release valve, a movable action rod to activate or deactivate said release valve, a control block linked with said plug, and a switching element capable of being activated by said control block at the time when said plug is acted on by said action rod, thereby resulting in interruption of power supply to said motor of said suction device.

2. The vacuum container as defined in claim 1, wherein said suction device is comprised of a built-in battery set serving as power source of said motor.

3. The vacuum container as defined in claim 1, wherein said motor of said suction device is externally connected to a power source.

4. The vacuum container as defined in claim 1, wherein said monitoring device further comprises an auxiliary expandable element fitted into said expandable casing such that one end of said auxiliary expandable element is extended into the hollow interior of said body.

5. The vacuum container as defined in claim 1, wherein one end of said action rod of said releasing device is extended out of the interior of said cap at the time when said releasing device is at work to enable said cap to be separated from said body.

* * * * *